US007180450B2

(12) United States Patent
Gloria et al.

(10) Patent No.: US 7,180,450 B2
(45) Date of Patent: Feb. 20, 2007

(54) SEMICONDUCTOR DEVICE WITH ANTENNA AND COLLECTOR SCREEN

(75) Inventors: Daniel Gloria, Grenoble (FR); Sébastien Montusclat, Meylan (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 11/071,596

(22) Filed: Mar. 3, 2005

(65) Prior Publication Data

US 2005/0206576 A1 Sep. 22, 2005

(30) Foreign Application Priority Data

Mar. 16, 2004 (FR) ..... 04 02710

(51) Int. Cl.
*H01Q 1/38* (2006.01)
*H01Q 7/08* (2006.01)
*H01Q 9/16* (2006.01)

(52) U.S. Cl. ..... 343/700 MS; 343/788; 343/793

(58) Field of Classification Search ..... 343/700 MS, 343/788, 793, 870
See application file for complete search history.

(56) References Cited

U.S. PATENT DOCUMENTS 4,654,622 A 3/1987 Foss et al.
5,386,214 A * 1/1995 Sugawara ..... 343/700 MS
5,386,215 A 1/1995 Brown
5,400,039 A * 3/1995 Araki et al. ..... 343/700 MS
5,903,239 A * 5/1999 Takahashi et al. ... 343/700 MS
6,424,315 B1 7/2002 Glenn et al.
2003/0132430 A1 7/2003 Tsai

OTHER PUBLICATIONS

Preliminary French Search Report, FR 04 02710, dated Jul. 13, 2004.

* cited by examiner

*Primary Examiner*—Shih-Chao Chen
(74) *Attorney, Agent, or Firm*—Jenkens & Gilchrist, PC

(57) ABSTRACT

A semiconductor device includes a substrate, for example made of silicon, and layers, deposited on this substrate. Within at least one of these layers a radio signal transmission/reception antenna is formed. Located between the antenna and the substrate, a screen for collecting induced currents between this antenna and this substrate is formed within at least one of the layers. The screen includes at least one main branch connected to a fixed potential, for example a ground reference, and a plurality of secondary branches connected to the main branch at one of their extremities. The collector screen accordingly presents a tree-like structure.

24 Claims, 8 Drawing Sheets

SEMICONDUCTOR DEVICE WITH ANTENNA AND COLLECTOR SCREEN

PRIORITY CLAIM

This application claims priority from French Application for Patent No. 04 02710 filed Mar. 16, 2004, the disclosure of which is hereby incorporated by reference.

BACKGROUND OF THE INVENTION

1. Technical Field of the Invention

The present invention relates to the field of semiconductor devices.

2. Description of Related Art

Radio signal transmission/reception antennas can be fabricated on glass plates so as to form components with reduced dimensions that are then associated, on connection plates, with integrated circuit components or directly mounted onto such circuits. Such structures require the fabrication, on the one hand, of the integrated circuits and, on the other hand, of the component antennas, followed by their assembly.

There is a need in the art for integrated circuit components that also integrate radio signal transmission/reception antennas. Preferably, these antennas should be of high quality even when the radio signals are high-frequency signals.

SUMMARY OF THE INVENTION

In accordance with an embodiment of the invention, a semiconductor device comprises a substrate, in particular made of silicon, and layers, deposited on this substrate, within at least one of these layers a radio signal transmission/reception antenna is formed.

According to an aspect of the invention, the semiconductor device also comprises, between the antenna and the substrate, a screen for collecting currents induced between this antenna and this substrate, this collector screen being formed within at least one layer and comprising at least one main branch connected to a fixed potential, in particular a ground, and secondary branches connected to the main branch by only one of their extremities such that this collector screen presents a tree-like structure.

According to an aspect of the invention, the collector screen is preferably symmetrical with respect to an axis corresponding to the axis of the antenna.

According to an aspect of the invention, the main branch of the collector screen preferably extends, in part at least, along the input/output strip of the antenna.

According to an aspect of the invention, the main branch of the collector screen is displaced with respect to the region or regions in which the field of the antenna is highest or the sensitivity of the antenna is highest.

BRIEF DESCRIPTION OF THE DRAWINGS

Advantages and features of the invention will become apparent upon examining the detailed description of the methods and embodiments of the invention, which are in no way limiting, and the appended drawings in which.

DETAILED DESCRIPTION OF THE DRAWINGS

Figure 1:
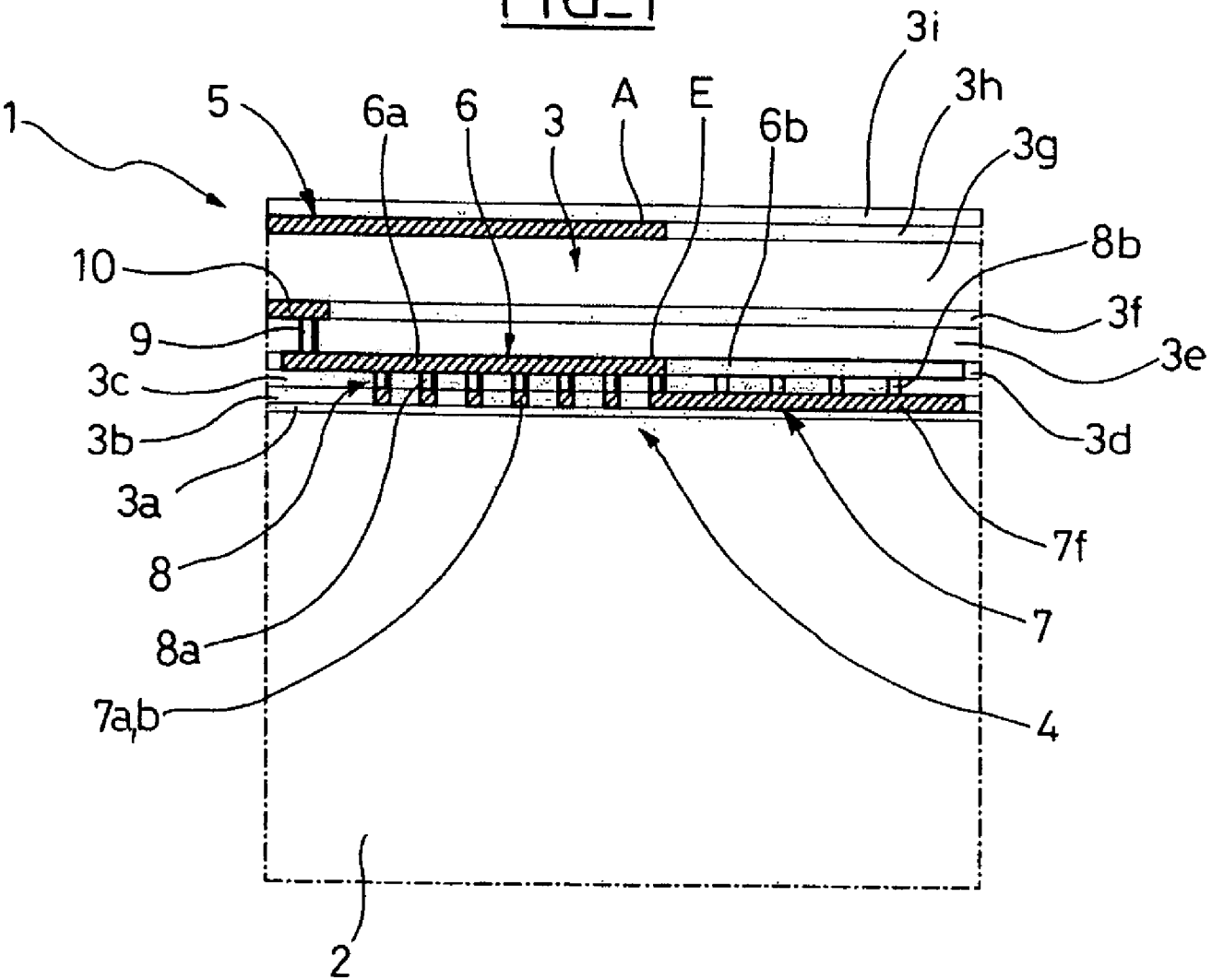
FIG. 1 shows a longitudinal cross section, taken along I—I of FIG. 2, of a semiconductor device according to an embodiment of the invention.
Figure 2:
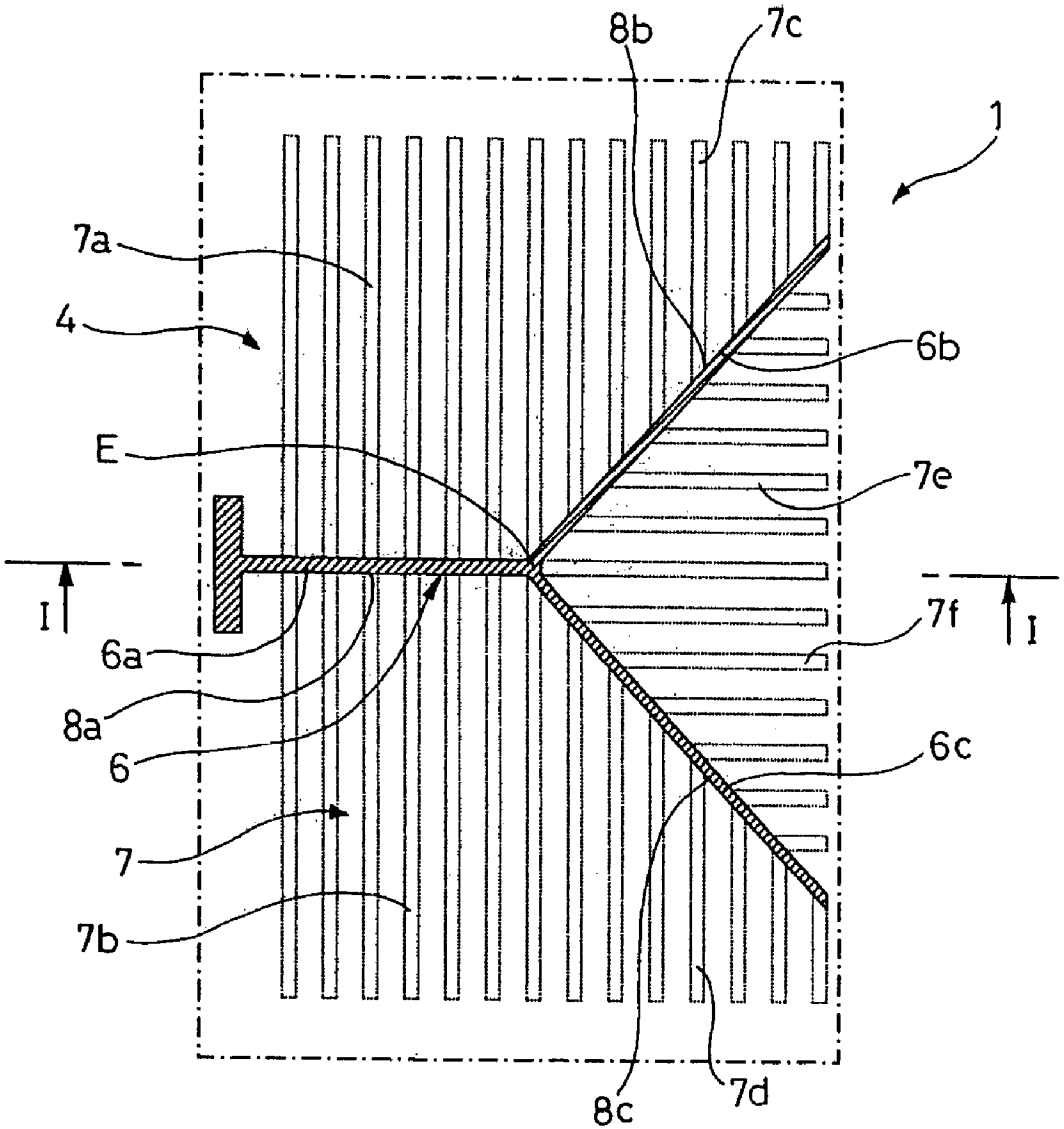
FIG. 2 shows a top view of a collector screen.
Figure 3:
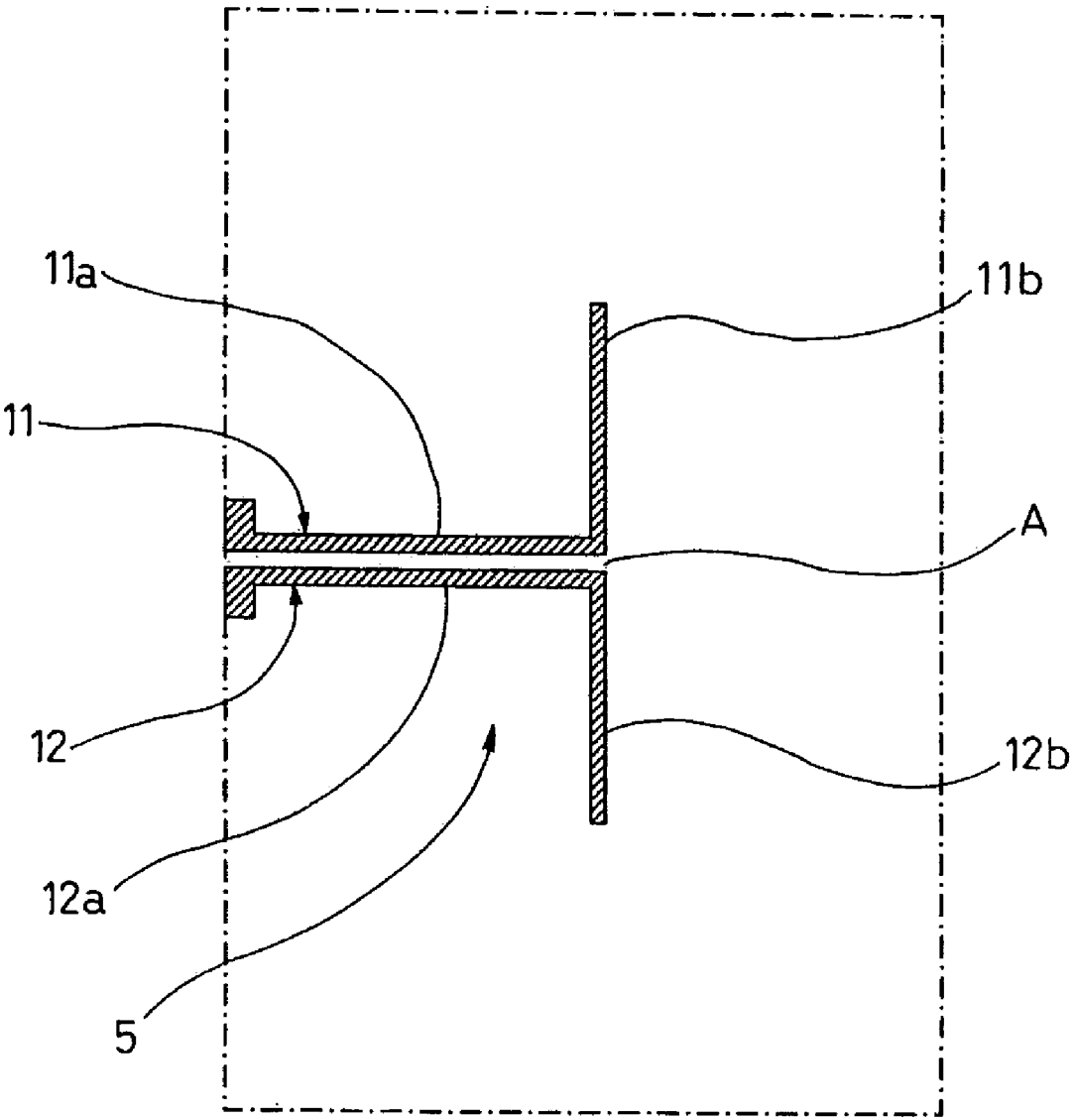
FIG. 3 shows a top view of an antenna.

With reference to FIGS. 1 to 3, a semiconductor device 1 comprising a silicon substrate 2, on which various layers 3 are deposited one on top of the other, is shown.

A collector screen 4 is formed within the layers close to the substrate 2 and a radio signal transmission/reception antenna 5 is formed within a layer close to the final layer.

The collector screen 4 is formed in the following manner. A layer 3*a* is deposited on the substrate 2. Within a fourth layer 3*d*, a main branch 6 is formed that comprises a longitudinal strip 6*a* and two strips 6*b* and 6*c* inclined at 45° and symmetrically with respect to the direction of the longitudinal strip 6*a*, such that the longitudinal strip 6*a* and the two inclined strips 6*b* and 6*c* form a Y shape. Within a second layer 3*b*, a multiplicity of secondary branches 7 are formed that are connected by vias 8 to the main branch 6 and that define, together with the latter, a tree-like structure.

For this purpose, this multiplicity of secondary branches 7 comprises a multiplicity of transverse strips 7*a* and 7*b* extending along either side of the longitudinal strip 6*a* of the main branch 6 and which are joined together underneath this strip 6*a*, where vias 8*a* link these junctions to the longitudinal strip 6*a*.

The multiplicity of secondary branches 7 also comprises a multiplicity of transverse strips 7*c* extending outside of the region situated between the two inclined strips 6*b* and 6*c* of the main branch 6 and a multiplicity of longitudinal strips 7*e* extending within this region, such that the transverse strips 7*c* and the longitudinal strips 7*e* form L shapes, and which are joined together underneath the strip 6*b*, where vias 8*b* link these junctions to the inclined strip 6*b*.

The multiplicity of secondary branches 7 further comprises a multiplicity of transverse strips 7*d* extending outside of the region situated between the two inclined strips 6*b* and 6*c* of the main branch 6 and a multiplicity of longitudinal strips 7*f* extending within this region, such that the transverse strips 7*d* and the longitudinal strips 7*f* form L shapes, and which are joined together underneath the strip 6*c*, where vias 8*c* link these junctions to the inclined strip 6*c*.

The transverse strips 7*a* and 7*c*, on the one hand, and the transverse strips 7*b* and 7*d*, on the other, are distributed periodically and the longitudinal strips are regularly spaced and are only connected to the main branch 6. The lengths of these strips are such that they extend over a rectangular area.

Above the layer 3*d*, a layer 3*e* is provided in which a via 9 is formed that is connected to the end part of the strip 6*a* of the main branch 6 opposite its strips 6*b* and 6*c* and, above this layer 3*e*, a layer 3*f* is provided in which a longitudinal strip 10, connected to the via 9, is formed.

At least one layer 3*g* is provided above the layer 3*f*.

The antenna 5 is formed in a next to last layer 3*h* and a last passivation layer 3*i* is provided above this layer 3*h*.

In this example, the antenna 5, being dipolar, comprises two strands 11 and 12 comprising two longitudinal strips 11*a* and 12*a* that are close to one another and run parallel to one another, above the longitudinal strip 6*a* of the collector screen 4, and two transverse strips 11*b* and 12*b* extending in opposite directions to one another.

The extremities of the strips 11*a* and 12*a* of the antenna 5 opposite to the branches are connected to an integrated component not shown here by means not shown, this component being a transmitter of an electrical signal in the case of a radio signal transmission antenna or a receiver of an electrical signal in the case of a radio signal reception antenna.

The antenna 5 and the collector screen 4 are disposed with respect to one another such that the junction region A of the strips 11*a*, 11*b* and 12*a*, 12*b* of the antenna 5 be above the junction region E of the strips 6*a*, 6*b* and 6*c* of the collector screen 4.

The length of the transverse strips 11*b* and 12*b* of the antenna 5 is smaller than the length of the transverse strips 7*a* and 7*b* of the collector screen 4, such that the antenna 5 is completely covered by the collector screen 4.

The field of the antenna 5 being highest or the sensitivity of the antenna being highest in the region of the aligned strips 11*b* and 11*c*, the strips 6*a*, 6*b* and 6*c* forming the main branch 6 of the collector screen 4 are angularly displaced with respect to the strips 11*b* and 12*b* of the antenna 5, the strip 6*a* by 90° and the strips 6*b* and 6*c* by 45°.

In one variant, the longitudinal strip 10 of the collector screen 4 extends in the opposite direction to the area covered by the latter so as to be connected to another part of the semiconductor device 1 at a fixed potential, such as a ground.

In another variant, this longitudinal branch 10 could be connected to the body of the antenna 5 or the via 9 could be extended so as to connect to the body of the antenna 5.

The collector screen 4 has the function of collecting the currents induced by electrostatic coupling between the antenna 5 and the silicon substrate 2. Its tree-like structure, which in addition has the same plane of symmetry as that of the antenna 5 in which plane the collector screen 4 and the antenna 5 have corresponding longitudinal axes of symmetry, prevents the induced currents from flowing in a loop.

Various variant embodiments of collector screen will now be described with reference to FIGS. 4 to 6.

Figure 4:
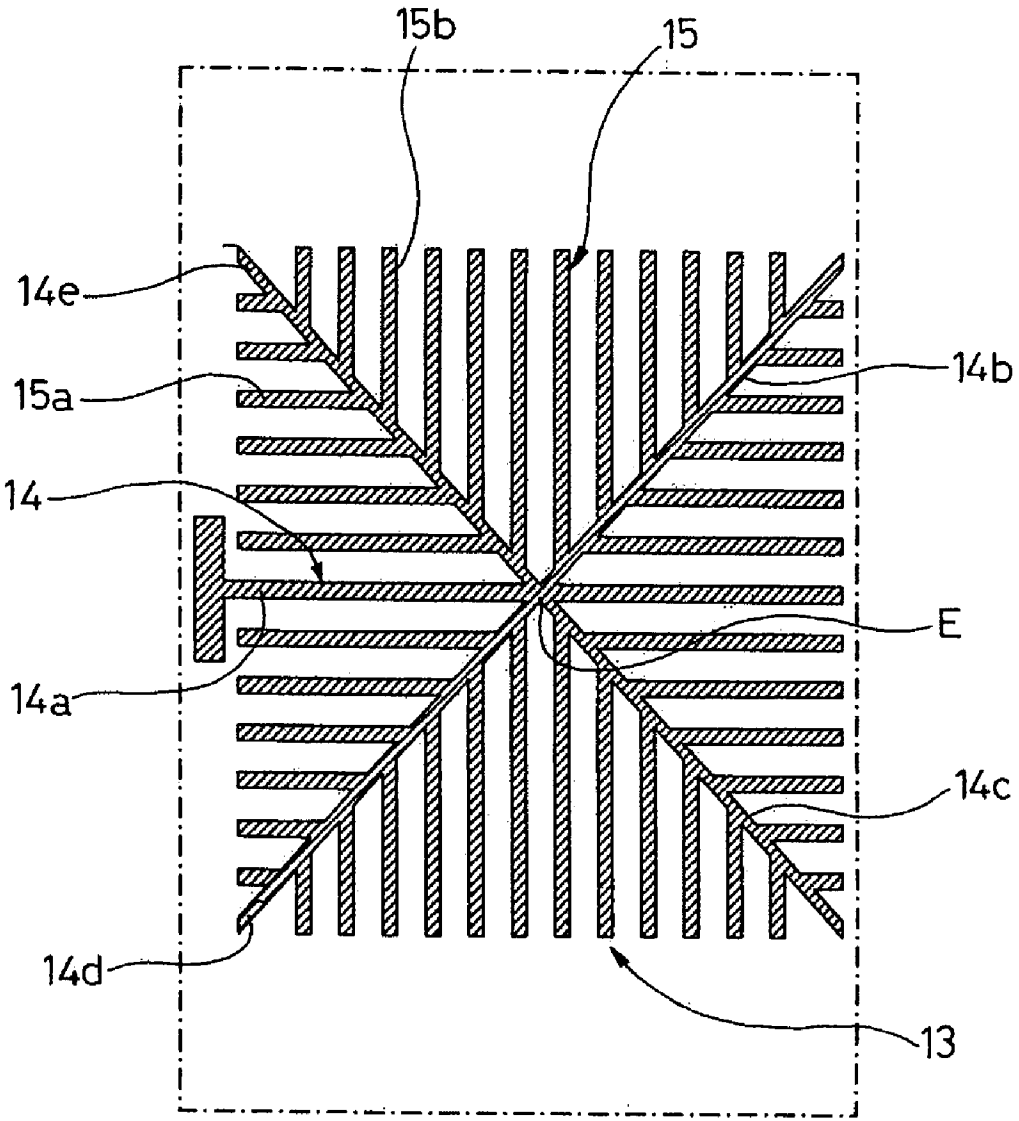
FIG. 4 shows a top view of another collector screen.

In contrast to the previous example, the collector screen 13 shown in FIG. 4 is formed within a single layer of the semiconductor device 1, for example in the layer 3*b*.

Like the collector screen 6, this collector screen 13 comprises a main branch 14 that has a longitudinal strip 14*a* and two inclined strips 14*b* and 14*c*. This main branch 14 also comprises two strips 14*d* and 14*e*, inclined at 45° and in the opposite direction to the strips 14*b* and 14*c*, such that the strips 14*b*, 14*c*, 14*d* and 14*e* form a cross. The collector screen 13 furthermore comprises a multiplicity of secondary branches 15 associated with the inclined strips 14*b*, 14*c*, 14*d* and 14*e* and which comprise longitudinal strips 15*a* and transverse strips 15*b* forming, as in the previous example, periodically-spaced L shapes.

Thus, as in the previous example, the collector screen 13 presents a tree-like structure whose strips 15*a* and 15*b* of its secondary branches 15 are connected to the strips 14*b*, 14*c*, 14*d* and 14*e* of its main branch 14 by only one of their extremities, this collector screen 13 also extending over a rectangular area.

In this example, the region E of the collector screen 13, such as is defined above, is situated in the center or at the junction point of the cross formed by the strips 14*b*, 14*c*, 14*d* and 14*e* of its main branch 14.

Figure 5:
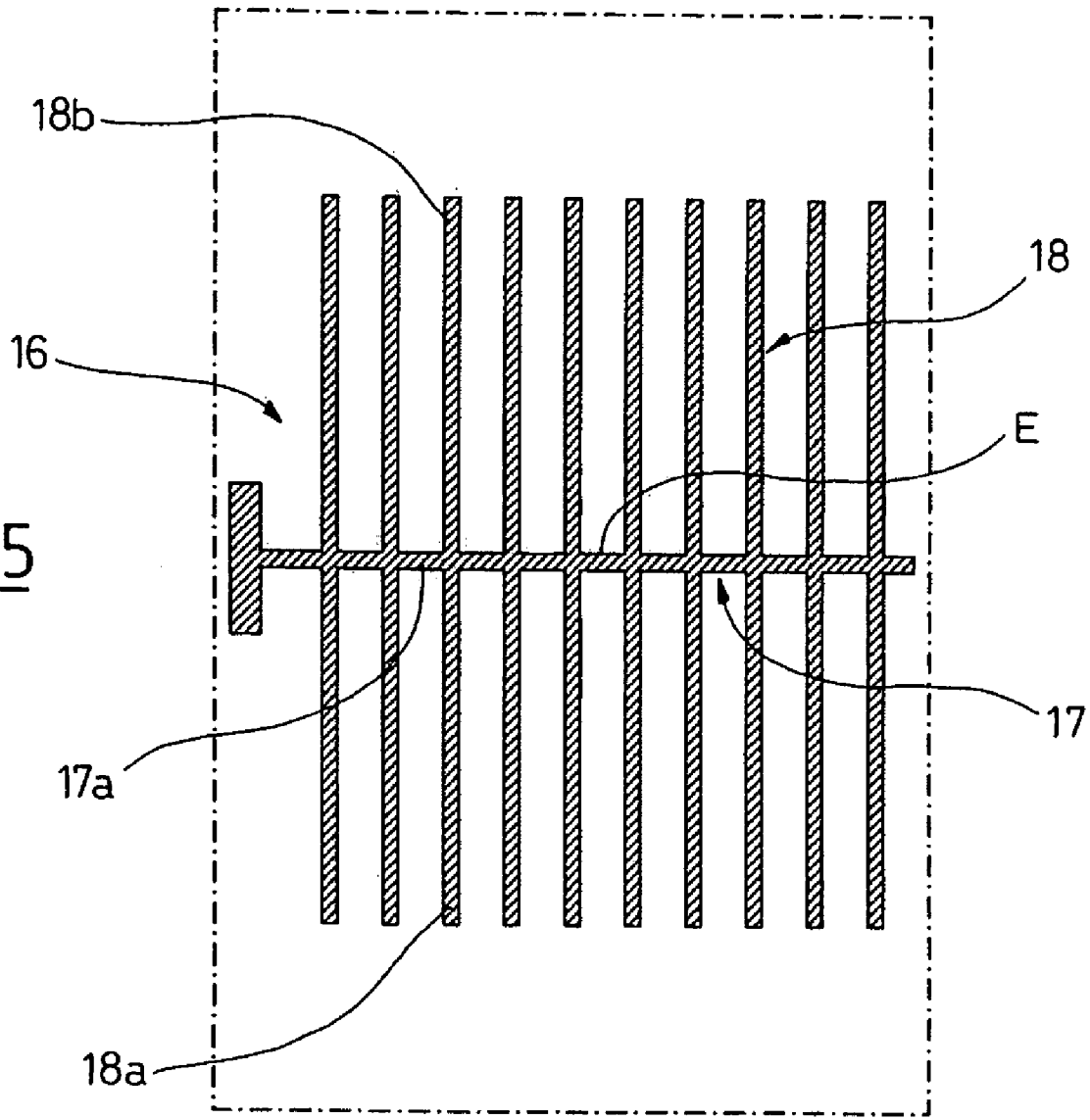
FIG. 5 shows a top view of another collector screen.

With reference to FIG. 5, a collector screen 16 is shown that is also formed within a single layer of the semiconductor device 1.

This collector screen 16 comprises a main branch 17 this time comprising only one longitudinal strip 17*a*. This collector screen 16 also comprises a multiplicity of secondary branches 18 comprising opposing and periodically-spaced transverse strips 18*a* and 18*b* connected by one of their extremities to the longitudinal strip 17*a*, such that this collector screen also presents a tree-like structure that also extends over a rectangular area.

In this example, the region E of the collector screen 16, such as is defined above, is situated half-way along the strip 17*a* forming its main branch 17.

Figure 6:
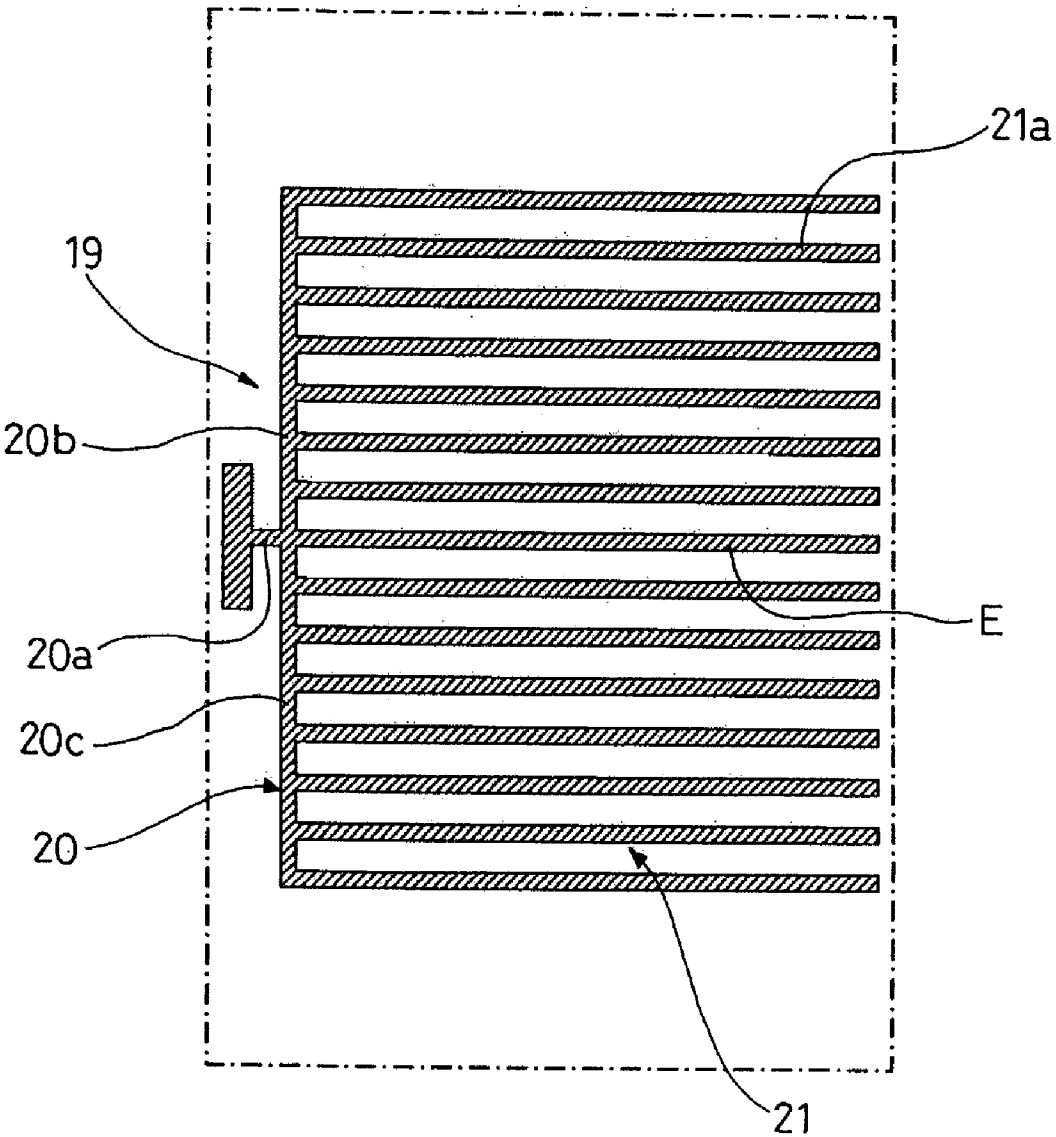
FIG. 6 shows a top view of another collector screen.

With reference to FIG. 6, a collector screen 19 is shown that is also formed within a single layer of the semiconductor device 1. This collector screen 19 comprises a main branch 20 which this time comprises a short longitudinal strip 20*a* and opposing transverse strips 20*b* and 20*c* that are joined together at the end of the longitudinal strip 20*a*. This collector screen 19 also comprises a multiplicity of secondary branches 21 that comprise periodically-spaced longitudinal strips 21*a* connected by one of their extremities to the transverse strip 20*b*, such that this collector screen also presents a tree-like structure that also extends over a rectangular area.

In this example, the region E of the collector screen 19, such as is defined above, is situated in the center of this rectangular area.

Various variant embodiments of transmission/reception antenna will now be described with reference to FIGS. 7 and 8.

Figure 7:
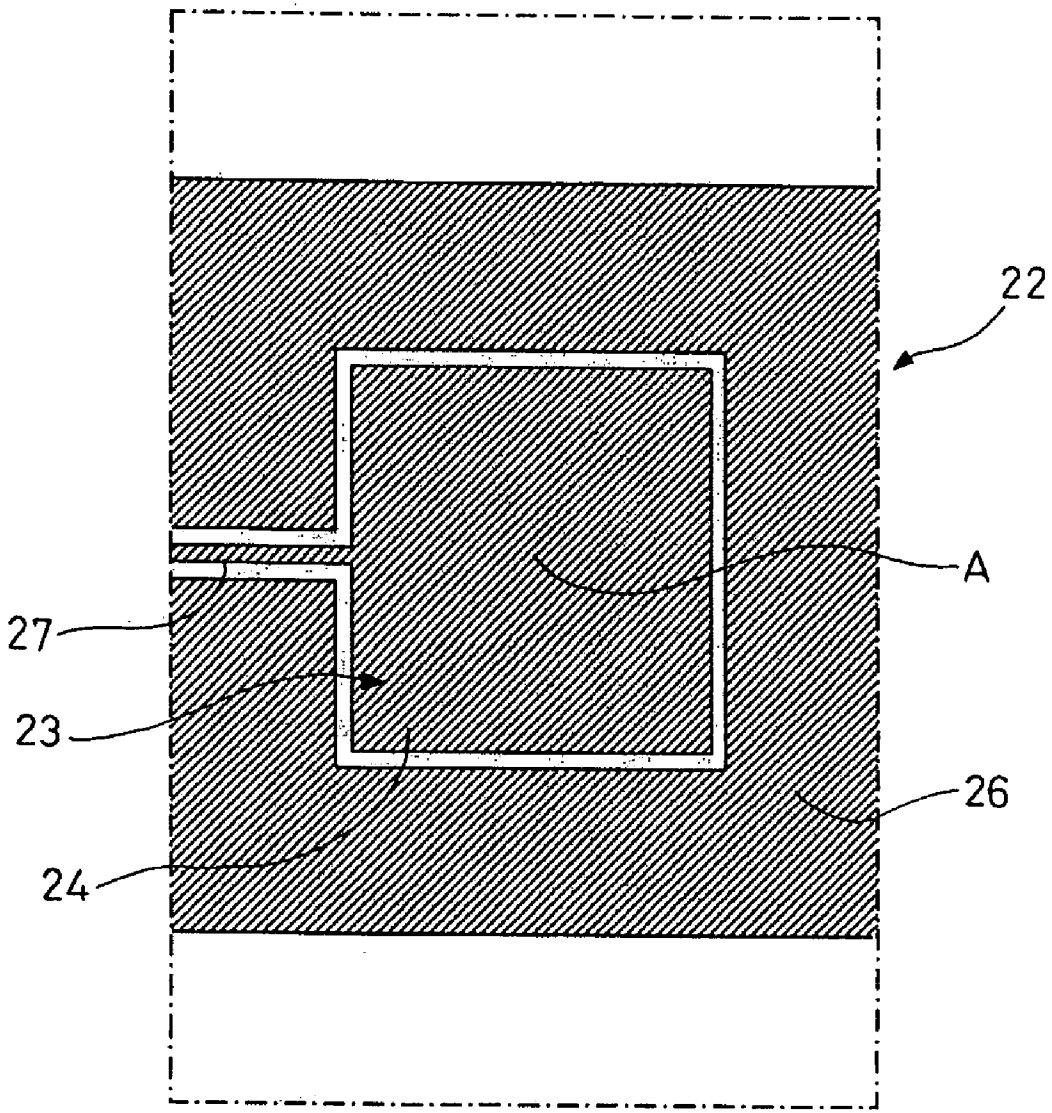
FIG. 7 shows a top view of another antenna.

The antenna 22 shown in FIG. 7 comprises a first part 23 formed by a central square region 24 and a median longitudinal strip 25 connecting to a circuit of the semiconductor component 1, and also a second part 26 formed by a wide region surrounding the periphery of the central region 24 separated by a small gap and extending up close to the longitudinal strip 25.

The field of the antenna 22 is highest or the sensitivity of the latter is highest in the region of the gap separating its central region 24 and its peripheral region 26. In this example, region A of the antenna 22, such as is defined above, is situated in the center of the square region 23.

Figure 8:
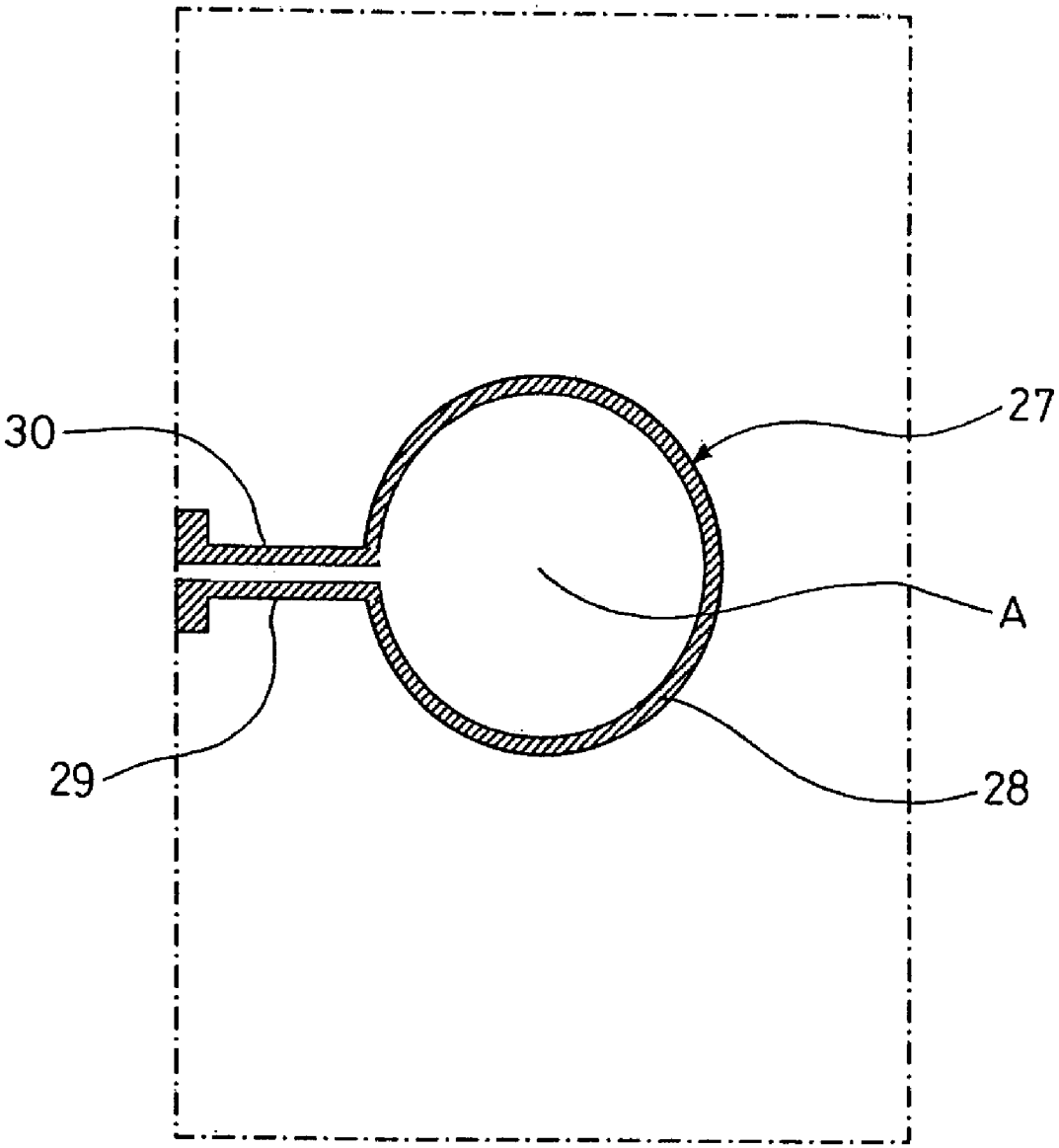
FIG. 8 shows a top view of another antenna.

The antenna 27 shown in FIG. 8 comprises a circular open ring 28 whose extremities are connected to closely-spaced median longitudinal strips 29 and 30 that connect to a circuit of the semiconductor component 1.

The field of the antenna 27 is highest or the sensitivity of the latter is highest in the region of the ring 28. In this example, the region A of the antenna 27, such as is defined above, is situated in the center of the circular ring 28.

In conclusion, semiconductor devices can be produced associating any one of the collector screens 4, 13, 16 or 19 with any one of the antennas 5, 22 or 27, by disposing them such that their region E be situated underneath their region A. Thus, the main branches of the collector screens are angularly or longitudinally displaced with respect to the regions of highest field intensity or of highest sensitivity of the antennas.

In addition, the surface areas covered by the collector screens cover the surface areas of the antennas.

Furthermore, the materials used in the fabrication of the strips forming the collector screens described above exhibit a conductivity preferably in the range $0.1\times10^7$ to $6\times10^7$ S/m. They can advantageously be made of aluminum, tungsten or polysilicon. In a preferred variant, the main branches of the collector screens are metallic and their secondary branches are made of polysilicon.

The materials used in the fabrication of the antennas described above may be chosen from aluminum, copper, tungsten or gold.

These antennas can be designed to have a range from a few centimeters to a few tens of meters and to transmit or receive radio signals at frequencies especially above 2 gigahertz.

The present invention is not limited to the examples described above. Many variant embodiments are possible, especially as regards the tree-like structure of the collector screens or the structure of the antennas and their formation in one or more layers, without departing from the scope of the invention defined by the appended claims.

What is claimed is:

1. A semiconductor device comprising:

a substrate, in particular made of silicon, and layers, deposited on this substrate, within at least one of which a radio signal transmission/reception antenna is formed;

wherein, between the antenna and the said substrate, a collector screen for collecting currents induced between this antenna and this substrate is formed within at least one layer, the collector screen comprising: at least one main branch connected to a fixed potential, in particular a ground, and secondary branches connected to the main branch by only one of their extremities such that this collector screen presents a tree-like structure.

2. The device according to claim 1, where the antenna is symmetrical with respect to an axis, and wherein the collector screen is symmetrical with respect to an axis corresponding to the axis of the antenna.

3. The device according to claim 1, wherein the main branch of the collector screen extends, in part at least, along an input/output strip of the antenna.

4. The device according to claim 1, wherein the main branch of the collector screen is displaced with respect to a region or regions in which a field of the antenna is highest or the sensitivity of the antenna is highest.

5. An integrated circuit structure, comprising:

a substrate layer;

a plurality of additional layers on top of the substrate layer, wherein at least a first one of those layers nearer to the substrate layer includes at least a portion of a generally tree-shaped collector screen structure and a second one of those layers nearer to a top one of those layers includes a radio signal antenna.

6. The structure of claim 5 wherein the radio signal antenna is suitable for operation to one of transmit and receive radio frequency signals in a gigahertz frequency range.

7. The structure of claim 5 wherein the generally tree-shaped collector screen structure is formed entirely within the first one of the layers.

8. The structure of claim 5 wherein the generally tree-shaped collector screen structure has a first portion formed within the first one of the layers and a second portion formed within a third one of the layers which is not adjacent to the first one of the layers.

9. The structure of claim 5 wherein the generally tree-shaped collector screen structure has at least one main branch and a plurality of sub-branches extending out therefrom.

10. The structure of claim 9 wherein the sub-branches extend out from the main branch perpendicularly.

11. The structure of claim 9 wherein the sub-branches extend out from the main branch at an acute angle.

12. The structure of claim 5 wherein the antenna is a dipole antenna.

13. The structure of claim 5 wherein the antenna is a loop antenna.

14. The structure of claim 5 wherein the antenna is ring antenna.

15. The structure of claim 5 wherein the generally tree-shaped collector screen structure has at least one main branch and a plurality of sub-branches extending out therefrom, the main branch being connected to a reference voltage potential.

16. The structure of claim 15 wherein the reference voltage potential is ground.

17. The structure of claim 5 wherein the generally tree-shaped collector screen structure has at least one main branch and a plurality of sub-branches extending out therefrom, the main branch being oriented such that it is not parallel to the antenna.

18. The structure of claim 5 wherein the antenna at least partially overlies the tree-shaped collector screen structure.

19. The structure of claim 5 wherein the antenna completely overlies the tree-shaped collector screen structure.

20. A semiconductor device comprising:

a semiconductor substrate;

multiple layers deposited on this substrate;

a radio signal transmission/reception antenna formed within one of the multiple layers; and a collector screen for collecting currents induced between the antenna and the substrate that is formed within at least one layer positioned between the antenna and the substrate, wherein the collector screen comprises at least one main branch connected to a fixed potential and secondary branches connected to the main branch.

21. The device of claim 20 wherein the main branch and secondary branches present a tree-like structure for the collector screen.

22. The device of claim 20, wherein the antenna is symmetrical with respect to a first axis, and wherein the collector screen is symmetrical with respect to a second axis, and the first and second axes are aligned.

23. The device of claim 20, wherein the at least one main branch is displaced with respect to a region or regions in which a field of the antenna is highest or the sensitivity of the antenna is highest.

24. A semiconductor device comprising:

a semiconductor substrate;

multiple layers deposited on this substrate;

a radio signal transmission/reception antenna formed within one of the multiple layers;

an input/output strip of the antenna; and a collector screen for collecting currents induced between the antenna and the substrate that is formed within at least one layer positioned between the antenna and the substrate, wherein the collector screen comprises at least one main branch that extends, at least in part, along the input/output strip of the antenna.

* * * * *